US011564869B2

(12) United States Patent
Casarez

(10) Patent No.: US 11,564,869 B2
(45) Date of Patent: Jan. 31, 2023

(54) COMBINED INFANT FEEDING AND PACIFIER RETENTION DEVICE

(71) Applicant: Carlos DaVhon Casarez, Milwaukee, WI (US)

(72) Inventor: Carlos DaVhon Casarez, Milwaukee, WI (US)

( * ) Notice: Subject to any disclaimer, the term of this patent is extended or adjusted under 35 U.S.C. 154(b) by 372 days.

(21) Appl. No.: 16/711,419

(22) Filed: Dec. 11, 2019

(65) Prior Publication Data

US 2020/0179232 A1 Jun. 11, 2020

Related U.S. Application Data

(60) Provisional application No. 62/778,202, filed on Dec. 11, 2018.

(51) Int. Cl.

| | |
|---|---|
| ***A61J 9/00*** | (2006.01) |
| ***A61J 11/00*** | (2006.01) |
| ***A61J 17/00*** | (2006.01) |

(52) U.S. Cl.

CPC ..... *A61J 9/008* (2013.01); *A61J 11/008* (2013.01); *A61J 17/001* (2015.05)

(58) Field of Classification Search

CPC ..... A61J 9/008; A61J 17/001; A61J 11/008
See application file for complete search history.

(56) References Cited

U.S. PATENT DOCUMENTS

| | | | | |
|---|---|---|---|---|
| 2,843,281 | A * | 7/1958 | Gallois | A61J 11/045 215/11.1 |
| 4,603,784 | A | 8/1986 | Chang | |
| 5,660,301 | A | 8/1997 | Kaplowitz | |
| 8,051,996 | B1 | 11/2011 | Amaya et al. | |
| 8,113,364 | B1 | 2/2012 | Asadi | |
| 2011/0278303 | A1 * | 11/2011 | Scobie | A61J 9/085 220/500 |

FOREIGN PATENT DOCUMENTS

| | | |
|---|---|---|
| WO | WO2010089582 A1 | 8/2010 |

* cited by examiner

*Primary Examiner* — Tri M Mai

(57) ABSTRACT

A combined infant feeding and pacifier retention device is an apparatus used to retain and distribute breastmilk or other fluids. The apparatus is also configured to store a pacifier for selective use. The apparatus comprises a liquid retention chamber, a pacifier retaining mechanism, and a feeding spout. The liquid retention chamber is a contained volume that enables transportation of inserted liquids, particularly milk or breastmilk. The pacifier retaining mechanism is a unit that enables storage of any of a variety of pacifiers. The feeding spout is a unidirectional valve that enables fluid transfer from the liquid retention chamber. The feeding spout is preferably made of any of a variety of soft, bisphenol A-free (BPA-free) materials that effectively operates when utilized as a mouthpiece for an infant. The general configuration of the aforementioned components allows the apparatus to efficiently and effectively store and distribute fluids to users.

14 Claims, 6 Drawing Sheets

COMBINED INFANT FEEDING AND PACIFIER RETENTION DEVICE

The current application claims a priority to the U.S. Provisional Patent application Ser. No. 62/778,202 filed on Dec. 11, 2018.

FIELD OF THE INVENTION

The present invention relates generally to articles of infant care equipment. Specifically, the combined infant feeding and pacifier retention device is a combination of a traditional feeding bottle with a modular retainer and cover mechanism for an associated pacifier.

BACKGROUND OF THE INVENTION

In present times, infants and young children are known to use pacifiers, teethers, or other similar "chew-toys" to occupy their mouths. Use of these devices has been recognized as a standard practice when caring for very young children since at least 1473; first noted by German physician Bartholomäus Metlinger in his book "*Kinderbüchlein*". Though the pacifiers used to be simple sweet-stuffs wrapped in a permeable cloth, modern pacifiers consist of a deformable, durable mouthpiece (structurally similar to a mother's nipple), a flanged guard (to prevent the infant from swallowing the toy), and a rear-mounted grab-ring. Also common in the infant care field is the ubiquitous baby bottle. This flexible fluid vessel is generally capped with a hollow, deformable silicone "teat" (also structurally similar to a mother's nipple) that a child may bite or suck to extract milk, formula, or other drinks from the vessel. Given the ubiquity and utility of these two devices, it is often desirable to have both available on-hand to feed a hungry child or occupy a fretful one. However, both of these devices must be kept clean during and between use, lest the vulnerable immune systems of the child are tested by ambient microbes or other harmful contaminants.

The present invention aims to allow a user to combine a pacifier and a drinking vessel into a single form for storage and transport. Additionally, the present invention discloses a means of maintaining the upright position of the drink-vessel portion of the present invention with the relocation of a dual-purpose cover component. Further, the means of fixing the pacifier to the drink vessel will constitute a means of fixing the mouthpiece in a sterile chamber, in addition to protecting the entire body of the pacifier from contact with contaminants when encased by the aforementioned cover component.

DETAILED DESCRIPTION OF THE INVENTION

All illustrations of the drawings are for the purpose of describing selected versions of the present invention and are not intended to limit the scope of the present invention.

Figure 2:
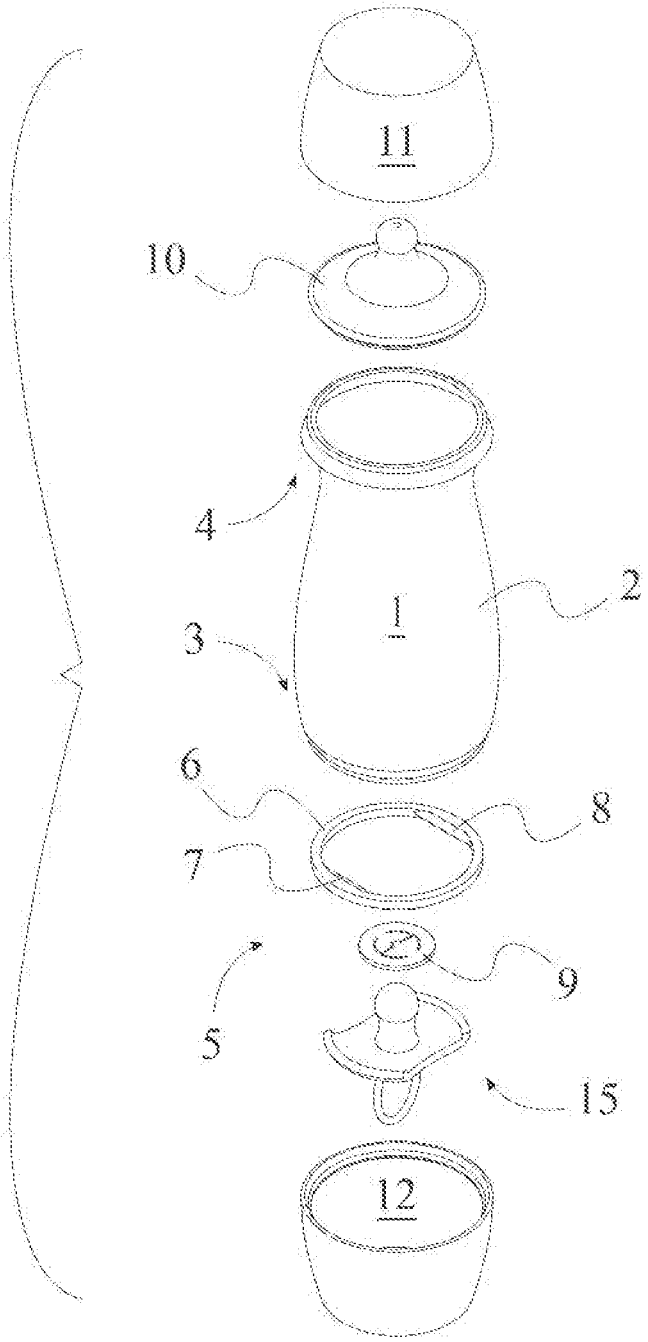
FIG. 2 is an exploded top-right perspective view of the present invention.

The present invention is a combined infant feeding and pacifier retention device that is used to retain and distribute breastmilk or other fluids. The present invention is also configured to store a pacifier for selective use. The present invention comprises a liquid retention chamber 1, a pacifier retaining mechanism 5, and a feeding spout 10, as seen in FIG. 2. The liquid retention chamber 1 is a contained volume that enables transportation of inserted liquids, particularly milk or breastmilk. The pacifier retaining mechanism 5 is a unit that enables storage of any of a variety of pacifiers. The feeding spout 10 is a unidirectional valve that enables fluid transfer from the liquid retention chamber 1. The feeding spout 10 is preferably made of any of a variety of soft, bisphenol A-free (BPA-free) materials that effectively operates when utilized as a mouthpiece for an infant.

Figure 1:
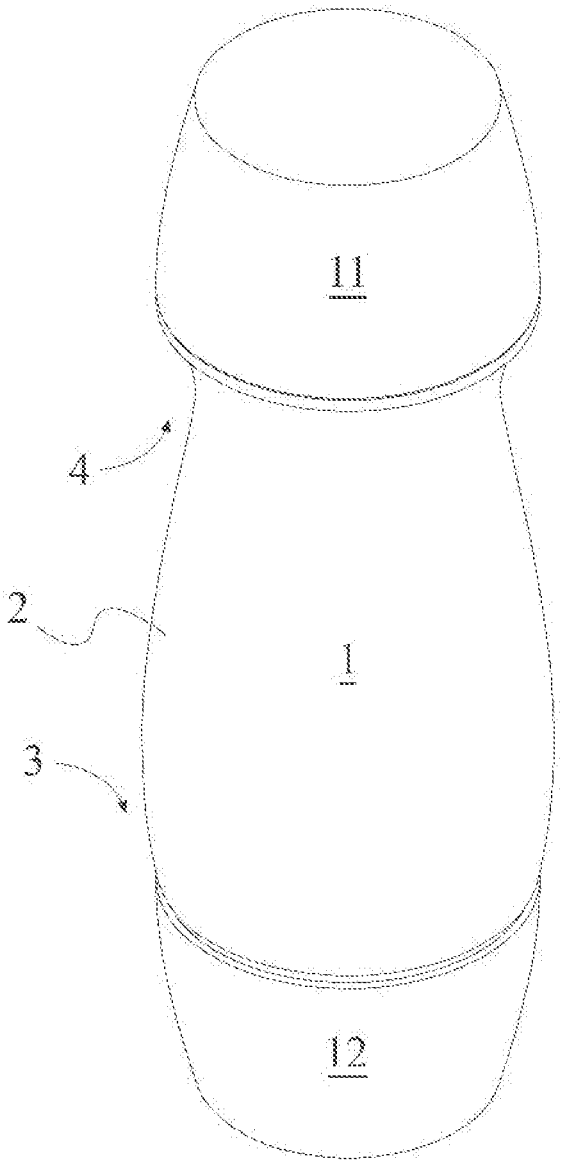
FIG. 1 is a top-left perspective view of the present invention.

The general configuration of the aforementioned components allows the present invention to efficiently and effectively store and distribute fluids to users. The liquid retention chamber 1 comprises a chamber body 2, a distal end 3, and a proximal end 4, as seen in FIG. 1. The chamber body 2 represents the physical volume occupied by the liquid retention chamber 1. The distal end 3 is an end segment of the liquid retention chamber 1 positioned away from the proximal end 4. Similarly, the proximal end 4 is an end segment of the liquid retention chamber 1 positioned away from the distal end 3. The pacifier retaining mechanism 5 comprises an annular ring 6, a first flexible edge 7, and a second flexible edge 8. The annular ring 6 is a circular extrusion that enables secure attachment of a pacifier within the pacifier retaining mechanism 5. The first flexible edge 7 is a generally flat extrusion across the annular ring 6 that enables improved retention of an added pacifier. Similarly, the second flexible edge 8 is a flat extrusion across the annular ring 6 that enables improved retention of an added pacifier, particularly when utilized in combination with the first flexible edge 7.

Figure 5:
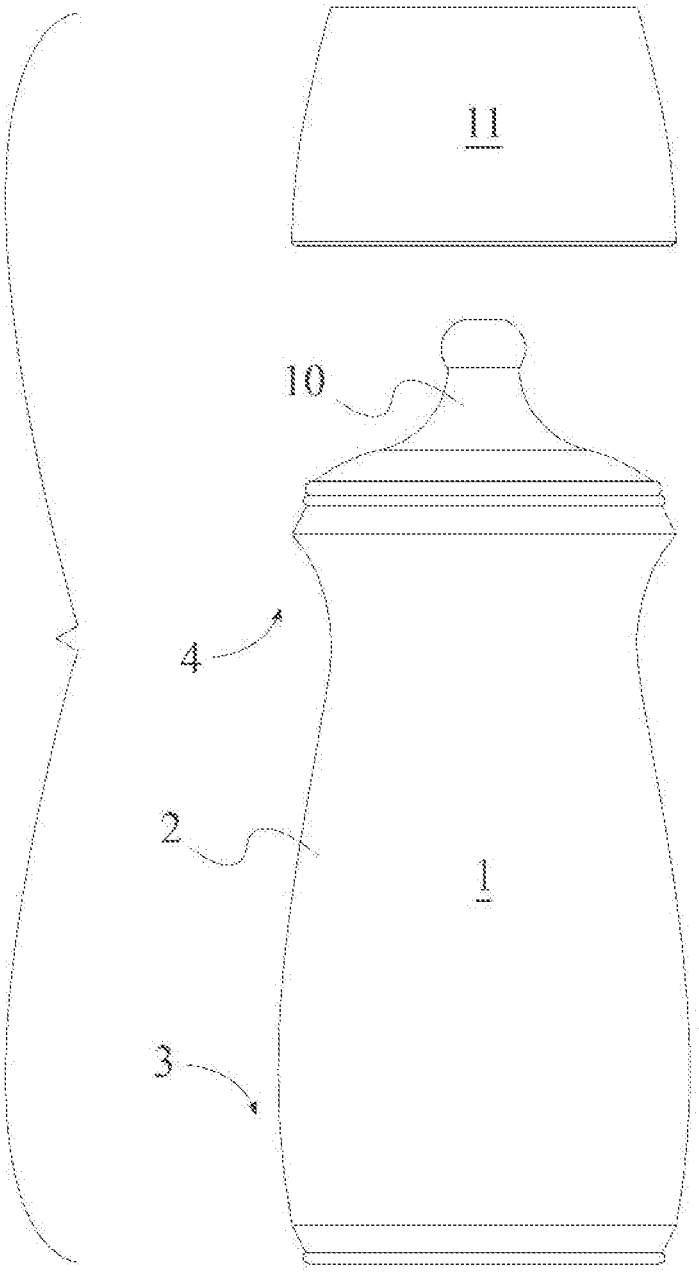
FIG. 5 is an exploded right view of the present invention.

Together, these components form the foundational units required to enable the preferred usage of the present invention. The distal end 3 and the proximal end 4 are positioned opposite each other about the chamber body 2, as seen in FIG. 5. This arrangement allows for arrangement of components relative to the chamber body 2. The feeding spout 10 is removably mounted to the proximal end 4. This arrangement enables the user to remove the feeding spout 10 in order to add or remove liquid from the liquid retention chamber 1. The feeding spout 10 is in fluid communication with the liquid retention chamber 1. In this way, liquids contained by the liquid retention chamber 1 may be dispensed through the feeding spout 10. The pacifier retaining mechanism 5 is connected to the distal end 3. This arrangement ensures the pacifier retaining mechanism 5 is placed in an easily accessible position. The first flexible edge 7 is diametrically opposed of the second flexible edge 8. Thus, the first flexible edge 7 and the second flexible edge 8 form a mount that allows for the storage of pacifiers. The first flexible edge 7 and the second flexible edge 8 are internally connected to the annular ring 6. In this way, the first flexible edge 7 and the second flexible edge 8 are positioned to enhance frictional engagement of items placed within the annular ring 6. The annular ring 6 is radially connected to the distal end 3. Thus, the annular ring 6 is arranged to contact items entering the distal end 3.

The pacifier retaining mechanism 5 may benefit from additional devices to assist in the secure retention of contained pacifiers. To achieve this, the pacifier retaining mechanism 5 further comprises a pacifier retainer disk 9, as seen in FIG. 2. The pacifier retainer disk 9 is a generally flat extrusion with preferably rubber internal flaps or cuts that improve the arrangement and retaining force of items, especially pacifiers, inserted into the pacifier retainer disk 9. The pacifier retainer disk 9 is externally integrated into the distal end 3. In this way, the pacifier retainer disk 9 is connected to ensure minimal movement of a contained pacifier. The pacifier retaining disk is positioned offset from the first flexible edge 7 and the second flexible edge 8. This arrangement allows the pacifier retaining disk to operate in conjunction with the annular ring 6.

Figure 3:
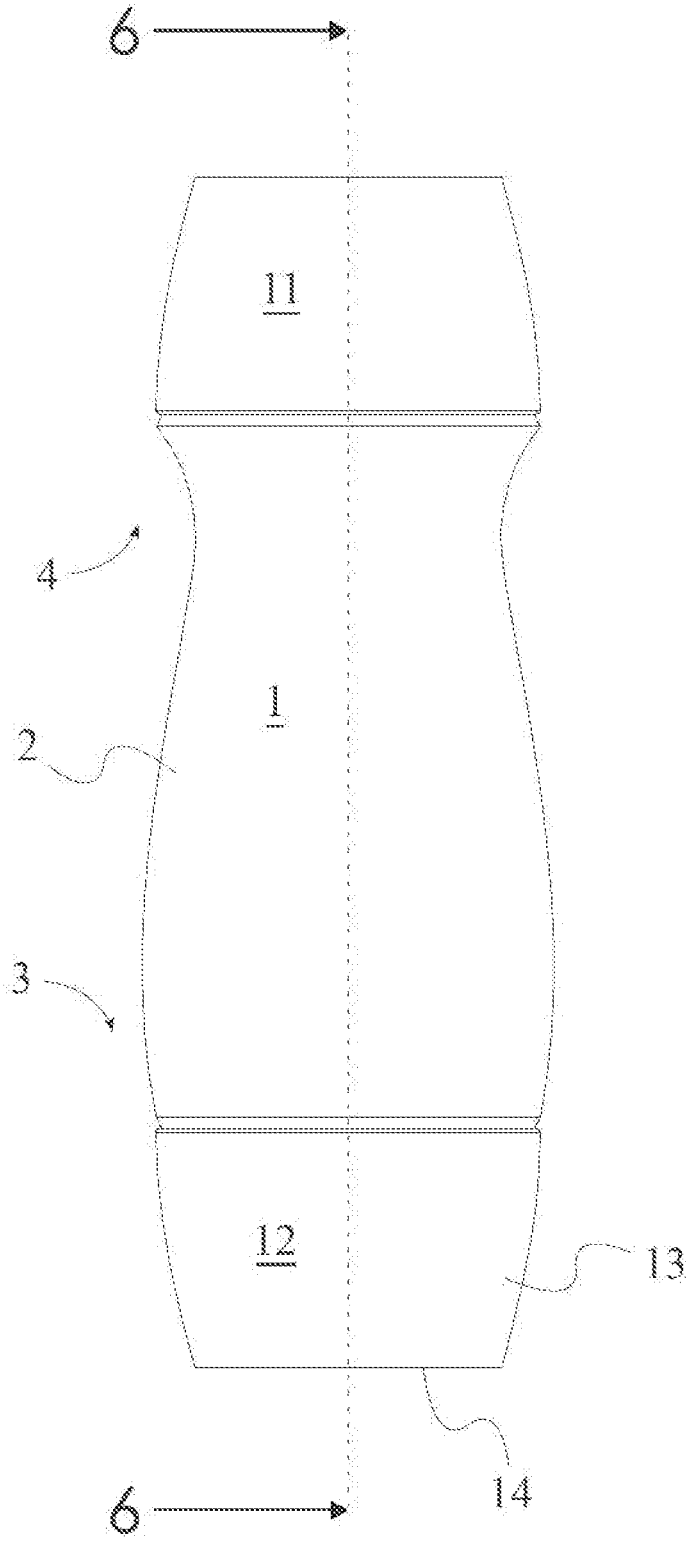
FIG. 3 is a right view of the present invention.

Cleanliness is especially important when dealing with infants, who have generally underdeveloped immune systems. To improve the hygienic capabilities of the present invention, the present invention further comprises a first cover 11, as seen in FIG. 3. The first cover 11 is a rigid enclosure capable of protecting contained items from undesirable contact with other objects or items. The first cover 11 is hermetically attached around the proximal end 4. This arrangement allows the first cover 11 to fully seal off components adjacent to the proximal end 4. The feeding spout 10 is encapsulated by the first cover 11. In this way, the feeding spout 10 is generally protected from contamination due to germs or bacteria originating outside the first cover 11.

Figure 4:
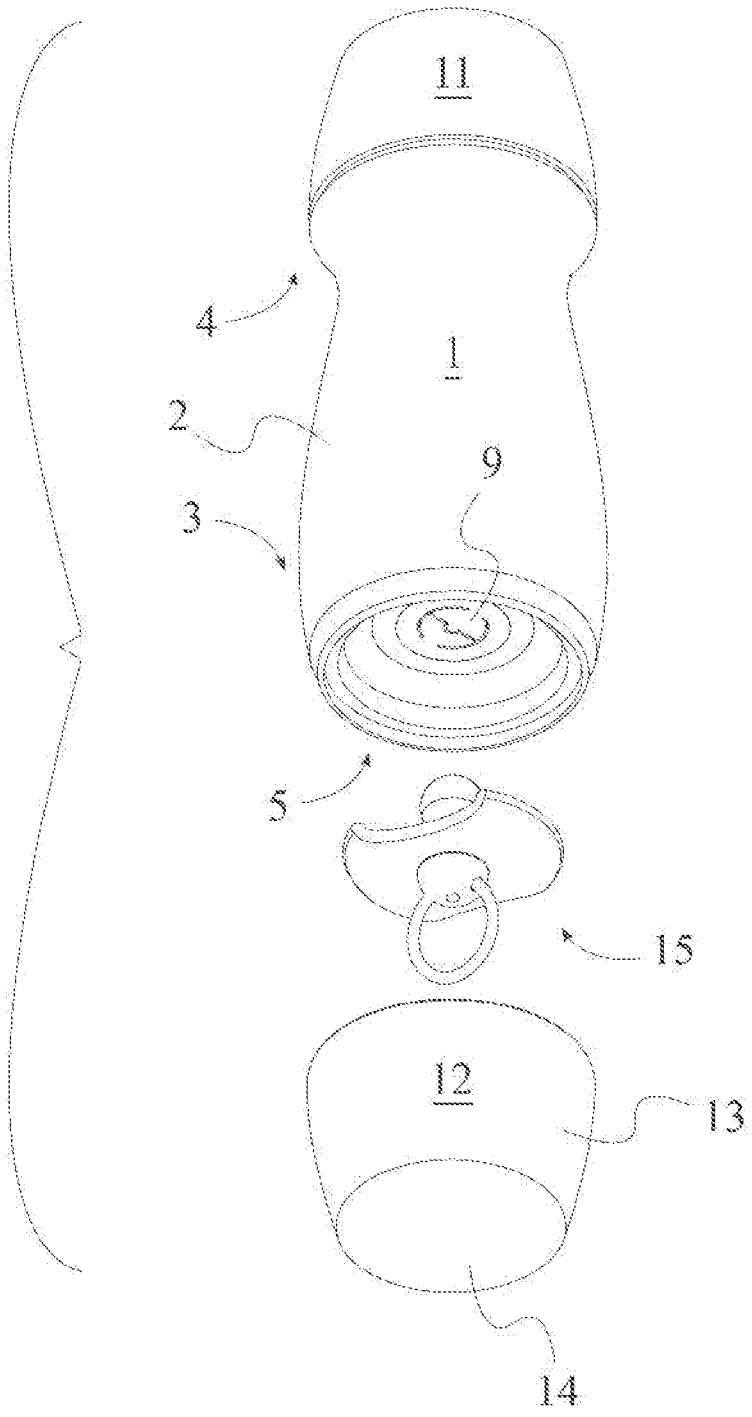
FIG. 4 is an exploded bottom-right perspective view of the present invention.

Much to the same end, hygiene requirements for any device intended for oral usage by infants must remain securely stored. To achieve this, the present invention comprises a second cover 12, as seen in FIG. 4. The second cover 12 is a rigid enclosure capable of protecting contained items from undesirable contact with other objects or items. The second cover 12 is hermetically attached around the distal end 3. This arrangement allows the second cover 12 to protect components that are adjacent to the distal end 3. The pacifier retaining mechanism 5 is encapsulated by the second cover 12. Thus, the pacifier retaining mechanism 5 is generally protected from contamination due to germs or bacteria originating outside the second cover 12.

The user may wish to know whether the second cover 12 is protecting a pacifier or an empty chamber. To this end, the second cover 12 is, in an exemplary embodiment, made of transparent materials. Such an arrangement is advantageous to a user who wishes to store or remove a contained pacifier.

In a further exemplary embodiment, the user may need to place the present invention down between uses, or else during refilling. To provide this ability, the second cover 12 comprises a lateral wall 13 and a base wall 14, as seen in FIG. 2. The lateral wall 13 is the generally curved wall that preferably conforms to the shape of the chamber body 2, forming a smooth curved grasping surface. The base wall 14 is a generally flat surface that enables support of the present invention upon the distal end 3. The lateral wall 13 is perimetrically connected around the base wall 14. This arrangement enables transferal of weight forces through the lateral wall 13 to the base wall 14. The lateral wall 13 is attached adjacent to the distal end 3. In this way, the weight of the distal end 3 is supported by the lateral wall 13. The base wall 14 is positioned opposite the distal end 3 about the lateral wall 13. This arrangement enables the base wall 14 to transfer the weight of the present invention to the surface upon which the base wall 14 rests.

The present invention may further benefit from the inclusion of a pacifier that is especially adapted for addition into the pacifier retaining mechanism 5 in order to prevent any possible compatibility issues. To this end, the present invention further comprises an integrated pacifier 15, as seen in FIG. 2. The integrated pacifier 15 is a tool which provides desirable oral stimulation for an infant. The integrated pacifier 15 is attached within the pacifier retaining mechanism 5. In this way, the integrated pacifier 15 is mounted conveniently and stored hygienically for later use.

Figure 6:
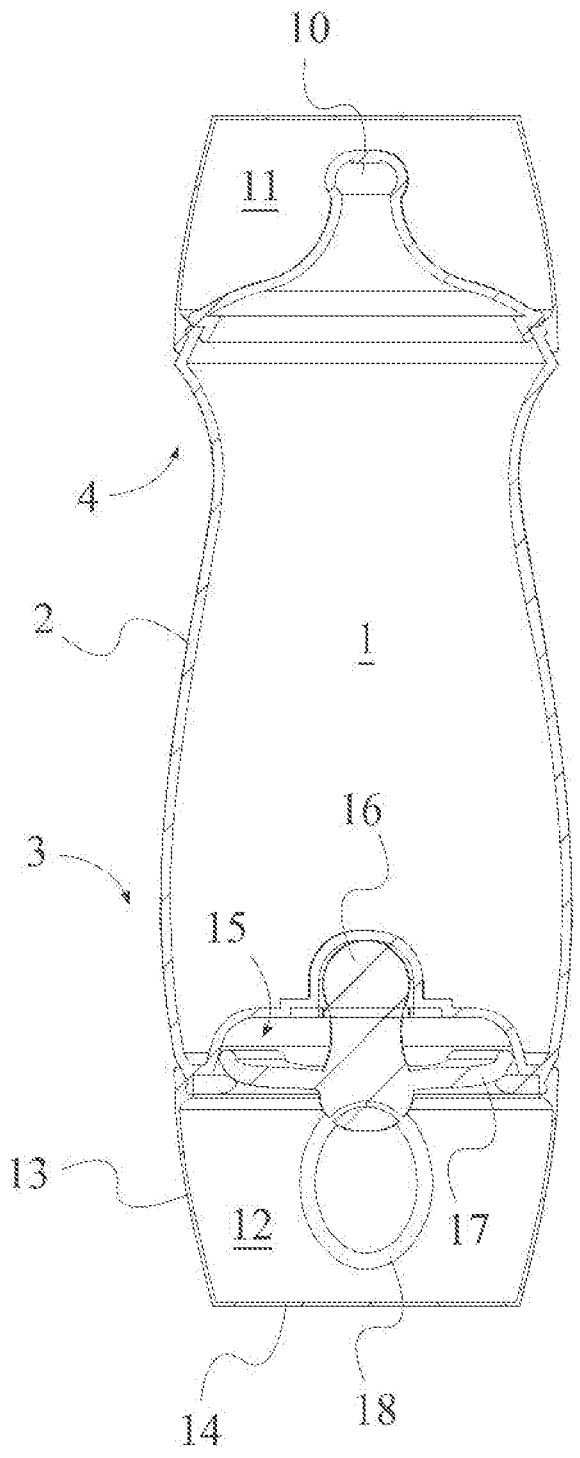
FIG. 6 is a right cross-sectional view of the present invention.

In an exemplary embodiment, the integrated pacifier 15 further includes components that facilitate convenient addition and removal from the pacifier retaining mechanism 5. The pacifier retainer disk 9 improves the ability of the pacifier retaining mechanism 5 to securely store pacifiers. The integrated pacifier 15 further comprises a nipple 16, a guard 17, and a pacifier ring 18, as seen in FIG. 6. The nipple 16 is a curved, preferably soft plastic protrusion intended to mimic the appearance and feel of a mother's nipple. The guard 17 is a wide disk or plate that prevents excessive dribble or spit from an infant to contact the pacifier ring 18. The pacifier ring 18 is a rigid loop that provides a grasping mechanism for the user, enhancing the user's ability to remove or add the integrated pacifier 15 into the pacifier retaining mechanism 5. The nipple 16 is frictionally engaged within the pacifier retainer disk 9. Thus, the nipple 16 is used to further enhance the arrangement of the integrated pacifier 15 within the pacifier retaining mechanism 5. The guard 17 is frictionally engaged with the first flexible edge 7 and the second flexible edge 8. In this way, the guard 17 is capable of further securing the integrated pacifier 15 within the pacifier retaining mechanism 5, preventing any undesirable movement or motion of the integrated pacifier 15 or other pacifiers. The pacifier ring 18 is enclosed within the distal end 3 and the second cover 12. In this way, the integrated pacifier 15 is fully contained within the second cover 12, and thus is fully protected from potential external contamination due to germs or unclean objects and items.

Although the invention has been explained in relation to its preferred embodiment, it is to be understood that many other possible modifications and variations can be made without departing from the spirit and scope of the invention as hereinafter claimed.

What is claimed is:

1. A combined infant feeding and pacifier retention device comprises:

a liquid retention chamber;

a pacifier retaining mechanism;

a feeding spout;

an integrated pacifier;

the liquid retention chamber comprises a chamber body, a distal end, and a proximal end;

the pacifier retaining mechanism comprises an annular ring, a first flexible edge, a second flexible edge, and a pacifier retainer disk;

the integrated pacifier comprises a nipple, a guard, and a pacifier ring;

the distal end and the proximal end being positioned opposite each other about the chamber body;

the feeding spout being removably mounted to the proximal end;

the feeding spout being in fluid communication with the liquid retention chamber;

the pacifier retaining mechanism being connected to the distal end;

the first flexible edge being diametrically opposed of the second flexible edge;

the first flexible edge and the second flexible edge being internally connected to the annular ring;

the annular ring being radially connected to the distal end;

the integrated pacifier being attached within the pacifier retaining mechanism;

the nipple being frictionally engaged within the pacifier retainer disk;

the guard being frictionally engaged with the first flexible edge and the second flexible edge; and the pacifier ring being enclosed within the distal end and a second cover.

2. The combined infant feeding and pacifier retention device as claimed in claim 1 comprises:

the pacifier retainer disk being externally integrated into the distal end; and the pacifier retaining disk being positioned offset from the first flexible edge and the second flexible edge.

3. The combined infant feeding and pacifier retention device as claimed in claim 1 comprises:

a first cover;

the first cover being hermetically attached around the proximal end; and the feeding spout being encapsulated by the first cover.

4. The combined infant feeding and pacifier retention device as claimed in claim 1 comprises:

a second cover;

the second cover being hermetically attached around the distal end; and the pacifier retaining mechanism being encapsulated by the second cover.

5. The combined infant feeding and pacifier retention device as claimed in claim 4, wherein the second cover is made of transparent materials.

6. The combined infant feeding and pacifier retention device as claimed in claim 4 comprises:

the second cover comprises a lateral wall and a base wall;

the lateral wall being perimetrically connected around the base wall;

the lateral wall being attached adjacent to the distal end; and the base wall being positioned opposite the distal end about the lateral wall.

7. A combined infant feeding and pacifier retention device comprises:

a liquid retention chamber;

a pacifier retaining mechanism;

a feeding spout;

an integrated pacifier;

the liquid retention chamber comprises a chamber body, a distal end, and a proximal end;

the pacifier retaining mechanism comprises an annular ring, a first flexible edge, a second flexible edge, and a pacifier retainer disk;

the integrated pacifier comprises a nipple, a guard, and a pacifier ring;

the distal end and the proximal end being positioned opposite each other about the chamber body;

the feeding spout being removably mounted to the proximal end;

the feeding spout being in fluid communication with the liquid retention chamber;

the pacifier retaining mechanism being connected to the distal end;

the first flexible edge being diametrically opposed of the second flexible edge;

the first flexible edge and the second flexible edge being internally connected to the annular ring;

the annular ring being radially connected to the distal end;

the pacifier retainer disk being externally integrated into the distal end;

the pacifier retaining disk being positioned offset from the first flexible edge and the second flexible edge;

the integrated pacifier being attached within the pacifier retaining mechanism;

the nipple being frictionally engaged within the pacifier retainer disk;

the guard being frictionally engaged with the first flexible edge and the second flexible edge; and the pacifier ring being enclosed within the distal end and a second cover.

8. The combined infant feeding and pacifier retention device as claimed in claim 7 comprises:

a first cover;

the first cover being hermetically attached around the proximal end; and the feeding spout being encapsulated by the first cover.

9. The combined infant feeding and pacifier retention device as claimed in claim 7 comprises:

a second cover;

the second cover being hermetically attached around the distal end; and the pacifier retaining mechanism being encapsulated by the second cover.

10. The combined infant feeding and pacifier retention device as claimed in claim 9, wherein the second cover is made of transparent materials.

11. The combined infant feeding and pacifier retention device as claimed in claim 9 comprises:

the second cover comprises a lateral wall and a base wall;

the lateral wall being perimetrically connected around the base wall;

the lateral wall being attached adjacent to the distal end; and the base wall being positioned opposite the distal end about the lateral wall.

12. A combined infant feeding and pacifier retention device comprises:

a liquid retention chamber;

a pacifier retaining mechanism;

a feeding spout;

a first cover;

a second cover;

an integrated pacifier;

the liquid retention chamber comprises a chamber body, a distal end, and a proximal end;

the pacifier retaining mechanism comprises an annular ring, a first flexible edge, a second flexible edge, and a pacifier retainer disk;

the integrated pacifier comprises a nipple, a guard, and a pacifier ring;

the distal end and the proximal end being positioned opposite each other about the chamber body;

the feeding spout being removably mounted to the proximal end;

the feeding spout being in fluid communication with the liquid retention chamber;

the pacifier retaining mechanism being connected to the distal end;

the first flexible edge being diametrically opposed of the second flexible edge;

the first flexible edge and the second flexible edge being internally connected to the annular ring;

the annular ring being radially connected to the distal end;

the pacifier retainer disk being externally integrated into the distal end;

the pacifier retaining disk being positioned offset from the first flexible edge and the second flexible edge;

the first cover being hermetically attached around the proximal end;

the feeding spout being encapsulated by the first cover;

the second cover being hermetically attached around the distal end;

the pacifier retaining mechanism being encapsulated by the second cover;

the integrated pacifier being attached within the pacifier retaining mechanism;

the nipple being frictionally engaged within the pacifier retainer disk;

the guard being frictionally engaged with the first flexible edge and the second flexible edge; and the pacifier ring being enclosed within the distal end and a second cover.

13. The combined infant feeding and pacifier retention device as claimed in claim 12, wherein the second cover is made of transparent materials.

14. The combined infant feeding and pacifier retention device as claimed in claim 12 comprises:

the second cover comprises a lateral wall and a base wall;

the lateral wall being perimetrically connected around the base wall;

the lateral wall being attached adjacent to the distal end; and the base wall being positioned opposite the distal end about the lateral wall.

* * * * *